United States Patent [19]

Williams

[11] 4,361,247

[45] Nov. 30, 1982

[54] SELF CLOSING TANK LID

[76] Inventor: Clarence E. Williams, 5122 N. State Rd. 39, LaPorte, Ind. 46350

[21] Appl. No.: 283,899

[22] Filed: Jul. 16, 1981

[51] Int. Cl.[3] ..... B65D 25/00

[52] U.S. Cl. ..... 220/88 R; 220/263

[58] Field of Search ..... 220/88 R, 263, 89, 335

[56] References Cited

U.S. PATENT DOCUMENTS

| | | | |
|---|---|---|---|
| 1,832,056 | 11/1931 | Spencer | 220/88 R |
| 1,834,989 | 12/1931 | Young | 220/88 R |
| 2,633,267 | 3/1953 | Lebus | 220/88 R |
| 2,685,984 | 8/1954 | Lisciahi | 220/88 R |
| 4,182,459 | 1/1980 | Williams | 220/88 R |

*Primary Examiner*—George T. Hall

*Attorney, Agent, or Firm*—Oltsch, Knoblock & Hall

[57] ABSTRACT

A safety receptacle including a tank and a lid therefor. The lid is shiftable between its open and closed positions by a linkage system connected to the lid by a linkage connector. The linkage system includes a member which overlies the lid and is connected to the linkage connector by a heat sensitive actuator which releases the linkage connector when the lid is open in the presence of fire thereby allowing the lid to close by its own weight.

2 Claims, 5 Drawing Figures

F

SELF CLOSING TANK LID

SUMMARY OF THE INVENTION

This invention relates to a safety receptacle for holding flammable liquids.

The safety receptacle includes a tank part having a lid connected thereto by a hinge. The lid covers the tank when in its closed position and is shiftable to its open position by a linkage system which is normally foot actuated. The lid returns to the closed position from its open position by its own weight upon foot release of the linkage system. In this manner, the lid automatically closes after each usage for safety purposes. On occasion a user of the receptacle will weight down or otherwise cause the linkage system to hold the lid open without foot actuation. In this invention, a heat sensitive safety device is used to allow the lid to close even when the lid is held open by the linkage system.

The linkage system includes a member which overlies the top surface of the lid and interfits with a connector carried by the lid. A heat sensitive actuating member attaches the connector and the linkage member, thus enabling the lid to be opened when the linkage system is operated. The heat sensitive actuator will release the linkage member from the connector when the lid is in the open position in the presence of a fire or other course of extreme heat, thus allowing the lid to fall into its closed position by its own weight.

Accordingly, it is an object of this invention to provide a novel safety receptacle.

Another object of this invention is to provide a safety receptacle including a heat releasable linkage system for shifting a lid from its open to its closed position.

Still another object of this invention is to provide a safety receptacle having a lid which carries a connector attached to a linkage member by a heat sensitive actuator which releases the connector from the linkage member when the lid is open in the presence of fire whereby the lid can shift from the open position to a closed position.

Other objects of this invention will become apparent upon a reading of the following description.

DESCRIPTION OF THE PREFERRED EMBODIMENT

The preferred embodiment illustrated is not intended to be exhaustive or to limit the invention to the precise form disclosed. It is chosen and described in order to explain the principles of the invention and its application and practical use to thereby enable others skilled in the art to utilize the invention.

Figure 1:
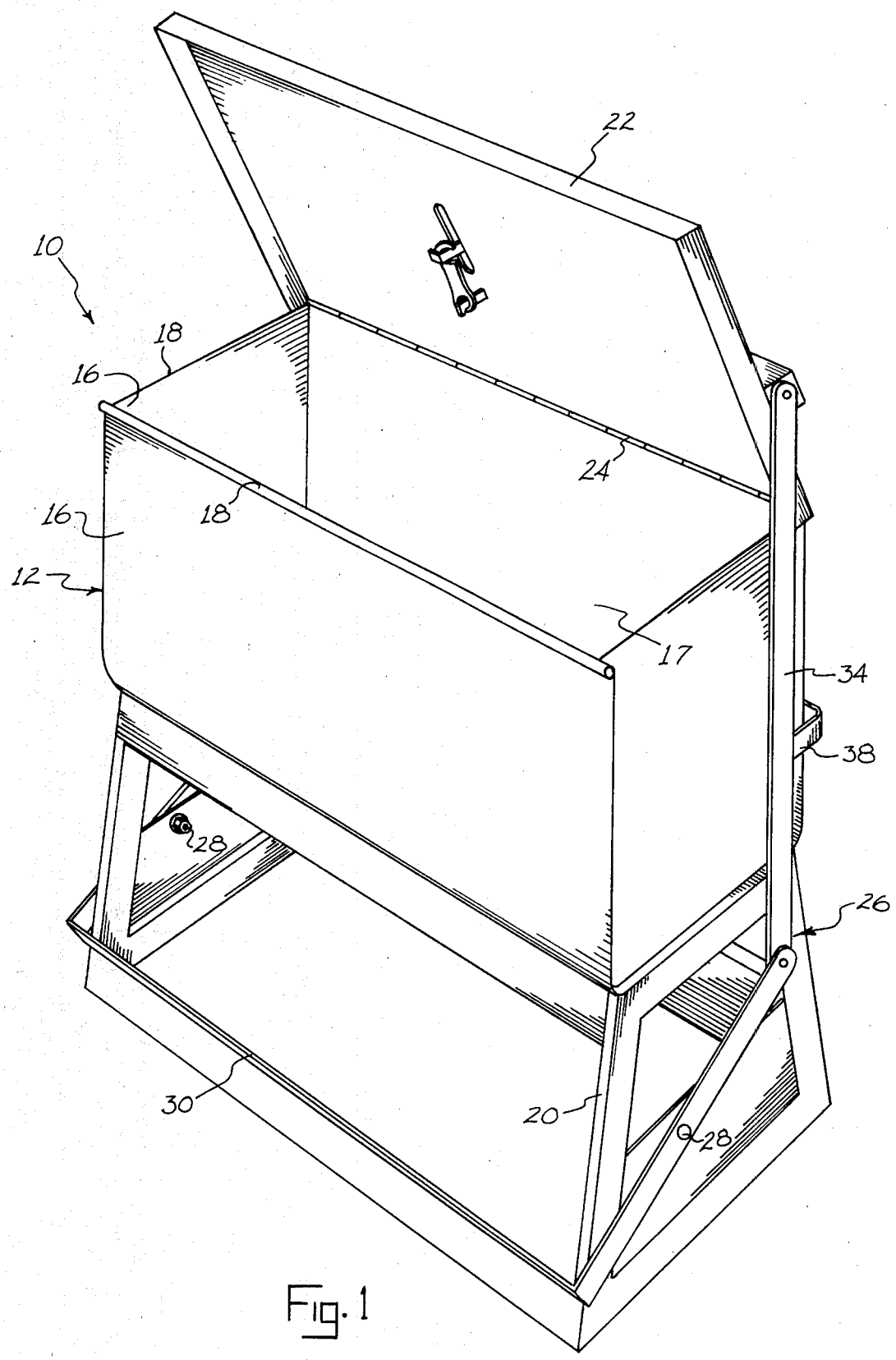
FIG. 1 is a perspective view of the safety receptacle showing the lid in its open position.
Figure 2:
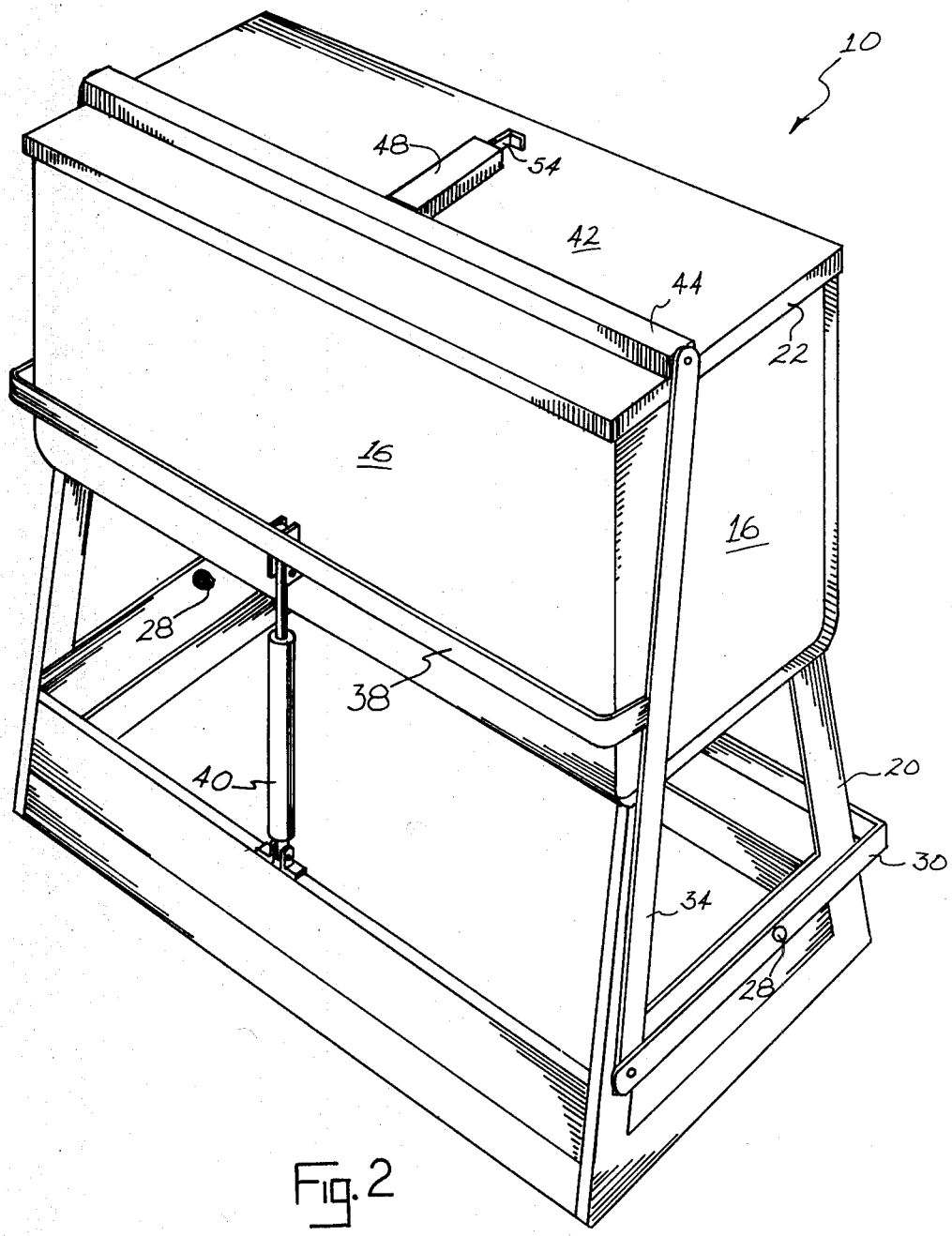
FIG. 2 is a side view of the safety receptacle showing the lid in its open position.
Figure 3:
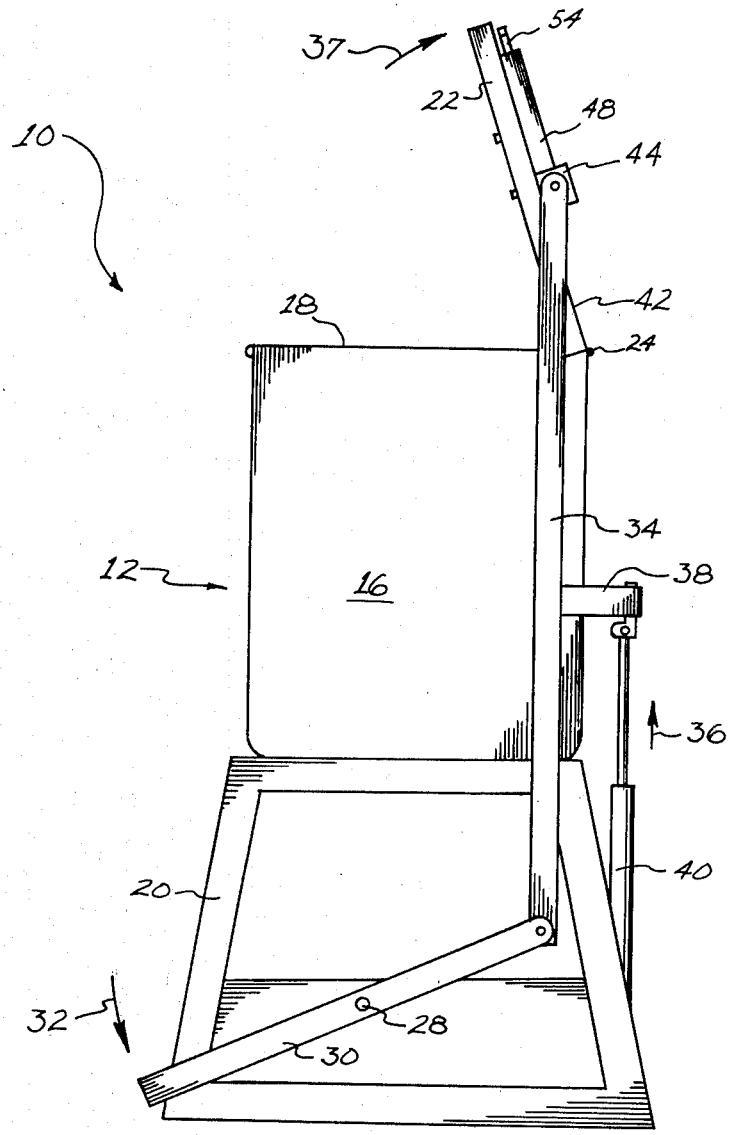
FIG. 3 is a rear view of the safety receptacle showing the lid in its closed position.

The safety receptacle 10 of this invention includes a housing or tank portion 12 having a side wall 16 with an upper marginal edge 18 defining an opening 17 in the receptacle. Receptacle 10 may be used as a dip tank for cleaning machine parts. Tank portion 12 is supported by a base 20. A lid 22 is connected to tank upper edge 18 by a hinge 24 and is pivotable about the hinge between a closed position, wherein the lid overlies opening 17, and an open position, wherein the lid is pivoted about the hinge approximately 75° from the tank upper edge. Lid 22 is connected to a linkage system 26 which is pivotable about a pin 28 located on base 20 such that depression of a cross linkage member 30, as indicated by arrow 32 of FIG. 3, causes vertical linkage members 34 to rise in the direction indicated by arrow 36, consequently pivoting the lid about hinge 24 as shown by arrow 37. A cross linkage member 38 is connected to linkage members 34 about the rear of the receptacle. A hydraulic cylinder 40, or some similar cushioning device, is connected between linkage member 38 and base 20. When linkage member 30 is released, such as by lifting of the user's foot from member 30, lid 22 will close due to its own weight and hydraulic cylinder 40 will prevent the lid from slamming down onto tank upper edge 18.

Figure 4:
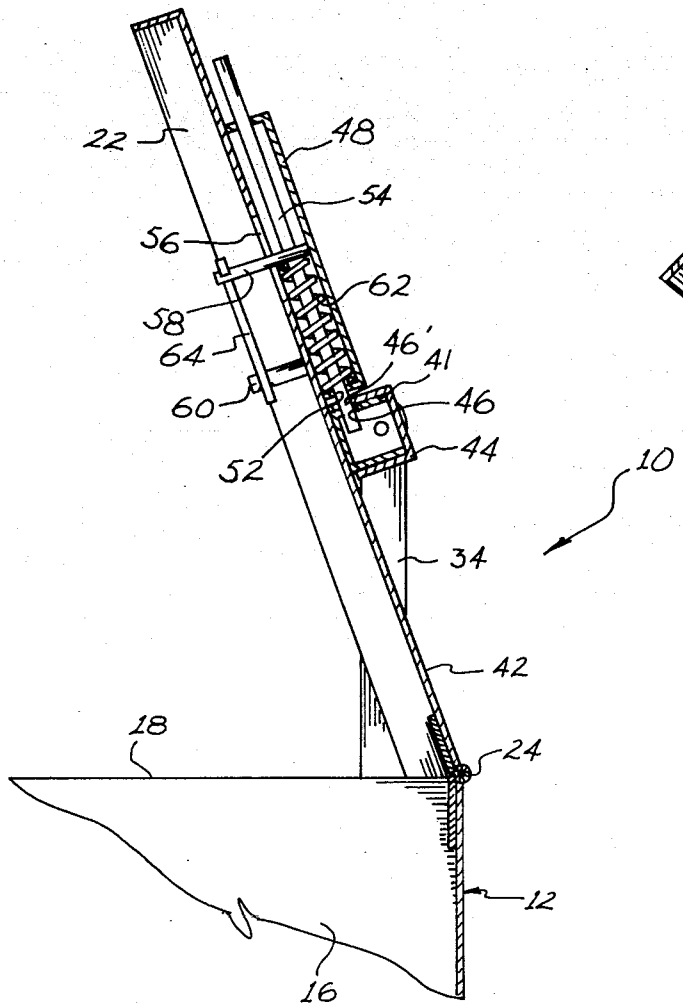
FIG.4 is a fragmentary sectionalized side view of the safety receptacle showing the lid in its open position with the linkage member attached to the lid connector.

Lid 22 carries a channel member 41 which extends along the length of the upper surface 42 of the lid. A cross linkage member 44 is connected at its ends to linkage members 34 and fits over channel member 41 during normal operation of receptacle 10. A slot 46 is formed in channel member 41 and a slot 46' is formed in linkage member 44 such that the slots are aligned when linkage member 44 is placed over the channel member. A housing 48 is carried on lid upper surface 42 and is positioned transversely to channel member 41. Housing 48 includes an end wall 50 which has an opening 52 therein alignable with slots 46, 46' of the interfitting channel and linkage members. A pin 54 fits within housing 48 and extends through opening 52 and aligned slots 46, 46' to secure linkage member 44 to member 41. A slot 56 is formed in lid 22 through which extends a lever 58 carried by pin 54. A second lever 60 is attached to lid 22 and is normally connected to lever 58 by a fusible link 64. A spring 62 is compressed between lever 58 and housing end wall 50 when levers 58, 60 are connected by fusible link 64. The above described construction is shown in FIG. 4.

Figure 5:
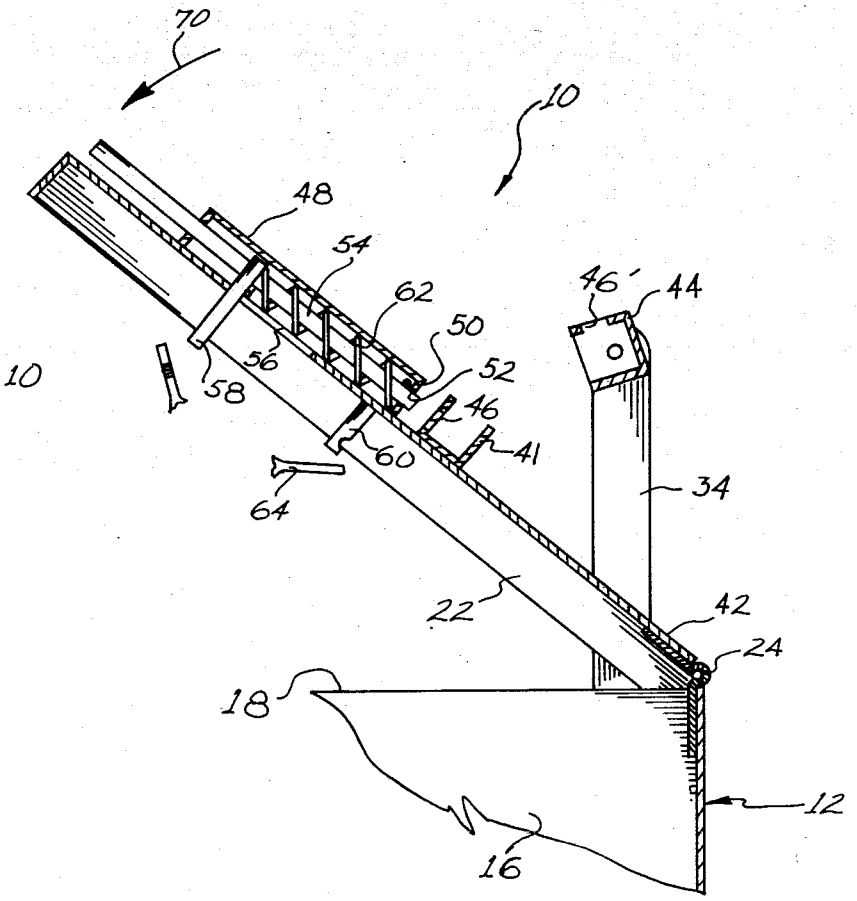
FIG. 5 is a fragmentary sectionalized side view of the safety receptacle showing the lid closing following release of the linkage member from the lid connector.

When lid 22 is held in the open position, either because of a bind in linkage system 26 or operator design, and is exposed to a fire or other source of heat greater than approximately 165° F., fusible link 64 will break or separate thereby releasing lever 58 and permitting pin 54 to be retracted from slots 46, 46' by the force of compressed spring 62. This releases linkage member 44 from channel member 41 as illustrated in FIG. 5, allowing lid 22 to fall to its closed position by its own weight as indicated by arrow 70, thus preventing or containing a fire in tank part 12.

It is to be understood that the invention is not to be limited to the description above but may be modified within the scope of the appended claims.

What is claimed is:

1. In a safety receptacle having a housing part and a lid part, said housing part including a side wall terminating in an upper marginal edge defining an opening in the housing part, a hinge connecting said lid part to said housing part, said lid part being shiftable about said hinge between a closed position spanning said opening and an open position, linkage means operable by a receptacle user for shifting said lid part between said closed position and said open position, said lid part normally being shiftable from its open position into its closed position by the weight of the lid part, the improvement wherein said linkage means includes a linkage member overlying said lid part, a connector carried by said lid part, a heat sensitive actuator means attaching said linkage member to said connector wherein said lid part is shiftable between its open and closed position upon operation of said linkage means, said heat sensitive actuator means for releasing said connector from said linkage member in the presence of a fire when the lid part is held by said linkage means in its open position whereby the lid part can shift into its closed position by its own weight.

2. The safety receptacle of claim 1 wherein said linkage means includes a pivoted cross member and vertical members each connected at one end to said cross member, said linkage member connected to the other end of said vertical members, said connector including a channel member fitting within said linkage member, said linkage member and said connector having alignable slots, said actuator means including a pin means having a first position where said pin means fits within said alignable slots to secure said lid to said linkage means whereby normal operation of said linkage means shifts said lid from its closed position to its open position and a second position where the pin means is withdrawn from the alignable slots separating said connector and said linkage member, said actuator means including biasing means for shifting said pin means from its said first position to its said second position, said pin means being retained in its first position by a fusible link wherein said pin means is released from its said first position and shifted to its second position in the presence of a fire when said lid part is held by said linkage means in its open position whereby the lid part can shift into closed position by its own weight.

* * * * *